US012428769B2

(12) United States Patent
Zielke et al.

(10) Patent No.: US 12,428,769 B2
(45) Date of Patent: Sep. 30, 2025

(54) METHOD AND CONTROL UNIT FOR CARRYING OUT A SPIN-DRY PROGRAM FOR A CLEANING APPLIANCE, AND CLEANING APPLIANCE

(71) Applicant: Miele & Cie. KG, Gütersloh (DE)

(72) Inventors: Marcel Zielke, Ennigerloh (DE); Magnus Kortenjann, Telgte (DE); Dirk Sieding, Lünen (DE); Markus Drücker, Gütersloh (DE); Benedikt Fechtel, Rheda-Wiedenbrück (DE); Steffen Lasner, Borgholzhausen (DE); Rainer Bicker, Verl (DE); Uwe Femmer, Gütersloh (DE)

(73) Assignee: MIELE & CIE. KG, Gütersloh (DE)

( * ) Notice: Subject to any disclaimer, the term of this patent is extended or adjusted under 35 U.S.C. 154(b) by 332 days.

(21) Appl. No.: 17/915,423

(22) PCT Filed: Mar. 22, 2021

(86) PCT No.: PCT/EP2021/057194
§ 371 (c)(1),
(2) Date: Sep. 28, 2022

(87) PCT Pub. No.: WO2021/197879
PCT Pub. Date: Oct. 7, 2021

(65) Prior Publication Data

US 2023/0287618 A1 Sep. 14, 2023

(30) Foreign Application Priority Data

Mar. 30, 2020 (DE) ..... 102020108677.6

(51) Int. Cl.
*D06F 35/00* (2006.01)
*D06F 23/02* (2006.01)
(Continued)

(52) U.S. Cl.
CPC ..... *D06F 35/007* (2013.01); *D06F 23/02* (2013.01); *D06F 33/40* (2020.02); *D06F 37/04* (2013.01); *D06F 37/38* (2013.01)

(58) Field of Classification Search
None
See application file for complete search history.

(56) References Cited

U.S. PATENT DOCUMENTS

2019/0169779 A1* 6/2019 Choi ..... D06F 33/36

FOREIGN PATENT DOCUMENTS

CN 107313209 A 11/2017
EP 0542137 A1 5/1993
(Continued)

OTHER PUBLICATIONS

JP H10216390 machine translation, Washing machine, Minayoshi (Year: 1998).*

(Continued)

*Primary Examiner* — Cristi J Tate-Sims
(74) *Attorney, Agent, or Firm* — Dickinson Wright PLLC

(57) ABSTRACT

A method for executing a spin program for a cleaning appliance having a rotatable, non-ribbed drum. A first motion signal is supplied which causes a first rotational motion of the drum in a first direction until the drum has reached a first target rotational speed. A second motion signal is supplied that represents a second rotational motion in a second direction until the drum has reached a second target rotational speed greater than the first target rotational speed. Further first and second motion signals are supplied which causes a further first and second rotational motions in the first and second directions until the drum has reached a further first and second target rotational speeds greater than the second and first target rotational speeds, respectively. A third motion signal causes a third rotation of the drum at the (Continued)

predetermined maximum rotational speed in the direction of the preceding rotational motion.

13 Claims, 4 Drawing Sheets

(51) Int. Cl.

| | |
|---|---|
| ***D06F 33/40*** | (2020.01) |
| ***D06F 37/04*** | (2006.01) |
| ***D06F 37/38*** | (2006.01) |

(56) References Cited

FOREIGN PATENT DOCUMENTS

| | | | | |
|---|---|---|---|---|
| IT | 0542137 | A1 * | 5/1993 | ..... D06F 35/007 |
| JP | H216390 | A | 8/1998 | |
| WO | 2020046076 | A1 | 3/2020 | |

OTHER PUBLICATIONS

KR 20110036028 A machine translation, Controlling of washing machine, Cho (Year: 2011).*

* cited by examiner

METHOD AND CONTROL UNIT FOR CARRYING OUT A SPIN-DRY PROGRAM FOR A CLEANING APPLIANCE, AND CLEANING APPLIANCE

RELATED APPLICATIONS

The present disclosure claims priority to and the benefit of PCT Application PCT/EP2021/057194, filed on Mar. 22, 2021, which claims priority to and the benefit of German Application 10 2020 108 677.6, filed on Mar. 30, 2020, the entire contents of which are incorporated herein by reference.

TECHNICAL FIELD

The disclosure relates to a method and to a control unit for executing a spin program for a cleaning appliance and to a cleaning appliance.

BACKGROUND

EP 2 309 048 A1 describes a drum for a washing machine having at least one engagement rib.

SUMMARY

The approach presented herein provides an improved method and an improved control unit for executing a spin program for a cleaning appliance, as well as an improved cleaning appliance.

According to the disclosure, this is achieved by a method and by a control unit for executing a spin program for a cleaning appliance and by a cleaning appliance having the features of the main claims. Advantageous embodiments and developments of the disclosure can be found in the subsequent sub-claims.

The advantages that can be achieved with the disclosure are that textiles can be spun safely even when using a non-ribbed drum. In addition, an imbalance and the resulting device overload can be avoided.

A method for executing a spin program for a cleaning appliance having a rotatable non-ribbed drum for holding the textiles is presented. The method comprises a step of supplying a first motion signal to an interface of a drive of the cleaning appliance, wherein the first motion signal causes a first rotational motion of the drum in a first direction until the drum has reached a first target rotational speed. Furthermore, the method comprises a step of supplying a second motion signal to the interface of the drive. The second motion signal represents a second rotational motion of the drum in a second direction opposite to the first direction, until the drum has reached a second target rotational speed that is greater than the first target rotational speed. The method also comprises a step of further supplying a further first motion signal to the interface of the drive of the cleaning appliance, wherein the further first motion signal causes a further first rotational motion of the drum in the first direction until the drum has reached a further first target rotational speed greater than the second target rotational speed of the preceding second rotational motion. In a step of further supplying, a further second motion signal is supplied to the interface of the drive, wherein the further second motion signal represents a further second rotational motion of the drum in the second direction, until the drum has reached a further second target rotational speed greater than the further first target rotational speed of the preceding further first rotational motion. In a step of repeating, at least one of the steps of further supplying is repeated until the further first target rotational speed or the further second target rotational speed reaches a predetermined maximum rotational speed. The method also comprises a step of supplying a third motion signal to the interface of the drive, wherein the third motion signal represents a third rotational motion of the drum at the predetermined maximum rotational speed in the direction of the preceding step of further supplying.

The method can be executed or controlled in a washing machine, for example, such as can be used for private purposes, but also for commercial purposes. The cleaning appliance can preferably be used for cleaning textiles, so that they run through a spin program, for example. The drum can also be referred to as a laundry drum, for example, and is shaped in order to clean the textiles inside. In this case, an inside of a drum casing of the drum is advantageously designed or can be designed to be smooth, with the exception of a plurality of nubs. A non-ribbed drum can be said to exist if the drum does not contain any geometry protruding from the surface where the drum radius is reduced by more than 10%. "Non-ribbed" can mean that the drum has no ribs on the inside that extend between the drum base and the drum opening, for example parallel to the axis of rotation of the drum. A nub can be understood to mean a hump-like elevation on the inside of the drum. A nub can be pyramid-shaped or tapered. A nub can have a circle or a regular polygon as its base. A nub can also be referred to as a structural element, hump, or mini entraining element. The drive can be implemented, for example, as a motor, which can set the drum in motion, for example in the first direction. The first direction of the first rotational motion of the drum and, for example, the further first rotational motion of the drum can, for example, correspond to a clockwise direction or, alternatively, to an anti-clockwise direction. Correspondingly, for example, the second direction of the second rotational motion of the drum and the further second rotational motion can correspond to the anti-clockwise direction or alternatively to the clockwise direction. The second rotational motion is advantageously greater than the first rotational motion, the further first rotational motion is greater than the second rotational motion and the further second rotational motion is greater than the further first rotational motion. As a result, the drum can advantageously be caused to execute a rocking rhythm, so that the textiles advantageously lie in contact with a drum casing of the drum in the non-ribbed drum. The third motion signal advantageously causes at least one complete revolution of the drum, for example to spin the textiles in the spin program.

According to one embodiment, the method may comprise a step of calculating the maximum rotational speed using a predetermined g-factor, a drum radius value representing a drum radius of the drum, and the gravitational constant. Advantageously, the g-factor can be in a range of between 2 and 6, with 4 being advantageous.

According to one embodiment, the second motion signal, the further first motion signal, and the further second motion signal can be supplied for a predetermined period of time, wherein the predetermined period of time corresponds to half a period duration of a rocking frequency. In this way, a back-and-forth rocking motion can be achieved.

According to one embodiment, the third motion signal can be supplied for a third period of time, wherein the third period of time is a multiple of the period duration. Advantageously, this allows complete revolutions of the drum.

According to one embodiment, the method may comprise a step of determining the rocking frequency using the drum radius value. For this purpose, the drum radius value can be read in via an interface of a memory unit, for example.

In the step of determining, according to one embodiment, the rocking frequency can be determined as a quotient of the square root from a quotient of the gravitational constant and the drum radius value as well as the doubled number Pi. As a result, a rocking frequency adapted to the cleaning appliance can be achieved.

According to one embodiment, the rocking frequency can be increased by a predetermined factor in the step of determining. The predetermined factor can be in a range of between 10% and 40%, for example; the factor is preferably 20%, for example. This allows the focus of the textiles to be spun to be taken into account.

According to one embodiment, the first motion signal, the second motion signal, the further first motion signal, and the further second motion signal can cause a constant acceleration of the drum. Thereby, the rotation control can be easily performed.

According to one embodiment, the first motion signal can cause a first acceleration of the drum, the second motion signal can cause a second acceleration of the drum greater than the first acceleration, the further first motion signal can cause a further first acceleration of the drum greater than the second acceleration, and the further second motion signal causes a further second acceleration greater than the further first acceleration. Advantageously, this allows for an ever-increasing rocking deflection, so that the textiles nestle evenly against the drum.

According to one embodiment, the maximum rotational speed can be reached in the step of repeating, in a third repetition process. Three rocking motions can advantageously be executed. As a result, the rocking start time can be kept short and the textiles can still be transported safely.

The approach presented herein also creates a control unit designed to execute, control, or implement the steps of a variant of a method presented herein in corresponding devices. The problem addressed by the disclosure can also be solved quickly and efficiently by this embodiment variant of the disclosure in the form of an apparatus.

The control unit can be designed to read in input signals and to determine and supply output signals using the input signals. An input signal can represent, for example, a sensor signal that can be read in via an input interface of the control unit. An output signal can represent a control signal or a data signal that can be supplied at an output interface of the control unit. The control unit can be designed to determine the output signals using a processing specification implemented in the hardware or the software. For example, the control unit can for this purpose comprise a logic circuit, an integrated circuit, or a software module and can be implemented as a discrete component or comprised by a discrete component.

A computer program product or computer program with program code which can be stored on a machine-readable carrier or storage medium, such as a semiconductor memory, a hard disk memory, or an optical memory, including non-transitory storage mediums even if such mediums do not necessarily store information permanently, for example random access memory (RAM), is also advantageous. If the program product or program is executed on a computer or a control unit, the program product or program can then be used to execute, implement, and/or control the steps of the method according to one of the embodiments described above.

Furthermore, a cleaning appliance for cleaning textiles is presented, which has a rotatable, non-ribbed drum for holding the textiles, a drive for setting the drum in a rotational motion, and a control unit in an aforementioned variant.

The cleaning appliance can be implemented, for example, as a standard washing machine or as a commercial or professional appliance. An inside of a drum casing of the drum can advantageously be smooth apart from a plurality of nubs.

BRIEF DESCRIPTION OF THE DRAWINGS

An embodiment of the disclosure is shown in the drawings in a purely schematic manner and will be described in more detail below. In the drawings.

DETAILED DESCRIPTION OF THE DRAWINGS

Figure 1:
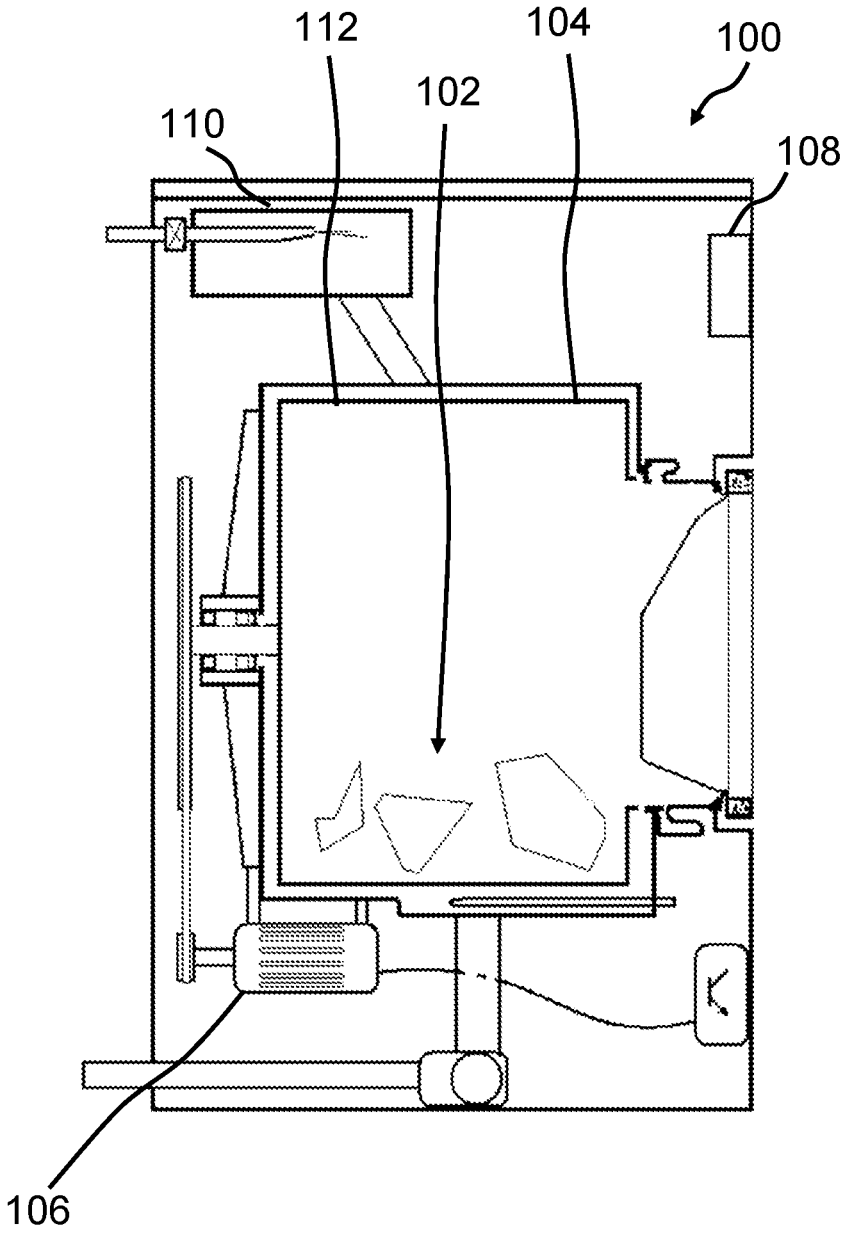
FIG. 1 is a schematic representation of a cleaning appliance according to one embodiment.

FIG. 1 shows a schematic representation of a cleaning appliance 100 according to one embodiment. The cleaning appliance 100 is designed to clean textiles 102. For this purpose, the cleaning appliance 100 has a rotatable non-ribbed drum 104, a drive 106, and a control unit 108. The drum 104 is non-ribbed and is designed to accommodate the textiles 102 in its interior. The drive 106 is designed to cause the drum 104 to execute a rotational motion and can, for example, comprise an electric motor. The control unit 108 is designed to control the drive and thereby cause the drum 104 to execute the rotational motion. Furthermore, the control unit 108 is designed, for example, to execute or control a method for executing a spin program of the cleaning appliance 100, as is described in one of the following drawings.

According to this embodiment, the cleaning appliance 100 also has a feed unit 110 which is designed to feed a cleaning liquid to a suds container 112 of the cleaning appliance 100 after the start of a cleaning program of the cleaning appliance 100, for example. The feed unit 110 comprises, for example, a valve via which the inlet of liquid from a feed line into a dispensing compartment can be controlled. The suds container 112 is designed to collect the cleaning liquid. The drum 104 is arranged in the suds container 112.

Figure 2:
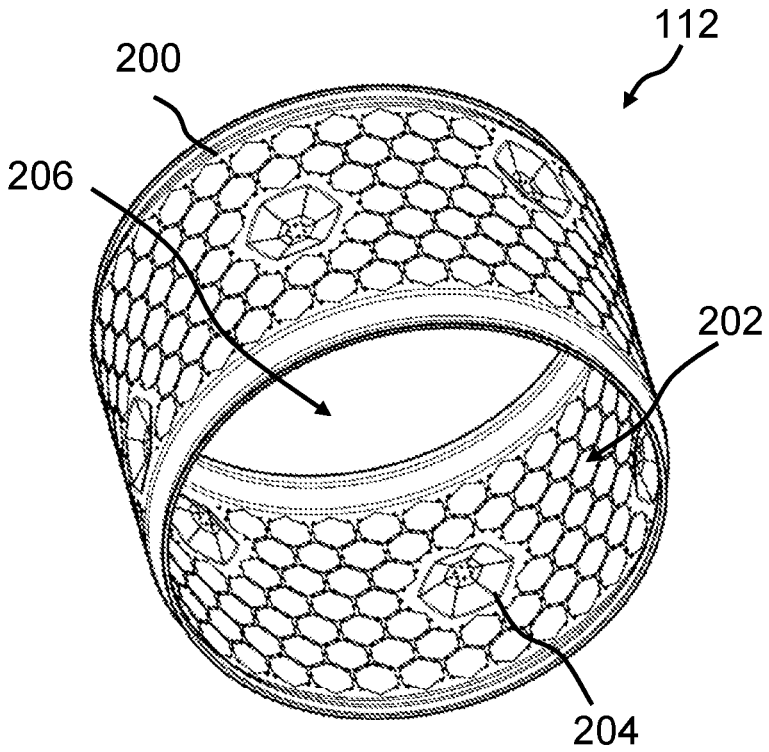
FIG. 2 is a perspective view of a non-ribbed drum for a cleaning appliance according to one embodiment.

FIG. 2 is a perspective view of a non-ribbed drum 112 for a cleaning appliance according to one embodiment. The drum 112 shown herein can correspond to the drum 112 as described in FIG. 1. Accordingly, the drum 112 shown herein can be used in a cleaning appliance, as was described in FIG. 1. In this case, the drum 112 has a drum casing 200 that forms a circumferential side wall of the drum 112. According to this embodiment, an inside 202 of the drum casing 200 is smooth, apart from a plurality of nubs 204. According to this embodiment, the nubs 204 are hexagonal and have a curved shape in the direction of an interior space 206 of the drum 112. Furthermore, according to this embodiment, the nubs 204 are arranged offset from one another and are surrounded by a honeycomb surface structure of the drum 112.

Figure 3:
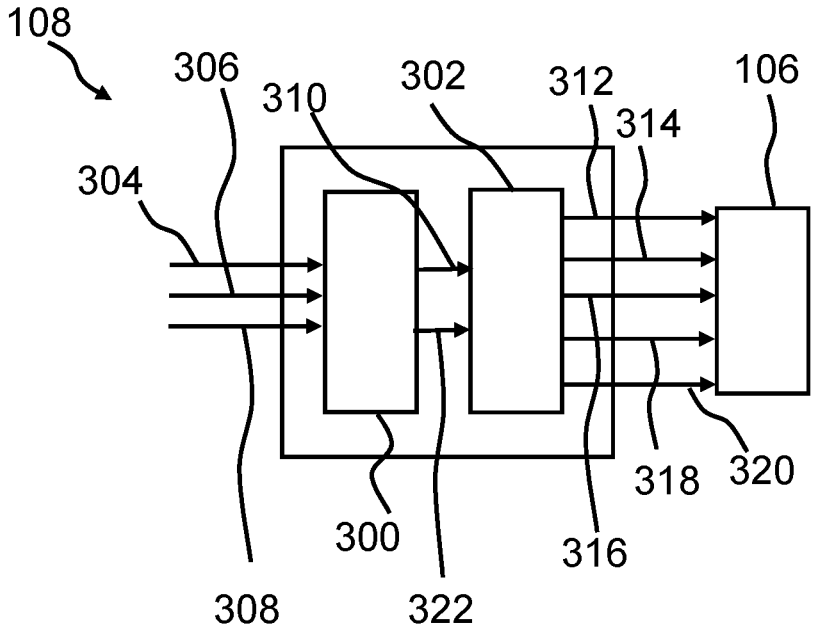
FIG. 3 is a block diagram of a control unit according to one embodiment.

FIG. 3 is a block diagram of a control unit 108 according to one embodiment. The control unit 108 can be used in a cleaning appliance, for example, as was described in FIG. 1, for example. According to this embodiment, the control unit 108 has a computing unit 300 and a supply unit 302.

The computing unit 300 is designed to calculate a maximum rotational speed 310 for a spinning process using a predetermined g-factor 304, a drum radius value 306 representing a drum radius of the drum, and the gravitational constant 308.

The supply unit 302 is designed to supply a first motion signal 312, a second motion signal 314, a further first motion signal 316, a further second motion signal 318, and a third motion signal 320 to an interface of the drive 106 of the cleaning appliance. The first motion signal 312 causes a first rotational motion of the drum in a first direction until the drum has reached a first target rotational speed. The second motion signal 314 causes a second rotational motion of the drum in a second direction, opposite the first direction, until the drum has reached a second target rotational speed greater than the first target rotational speed. The further first motion signal 316 continues to cause a further first rotational motion of the drum in the first direction until the drum has reached a further first target rotational speed greater than the second target rotational speed of the preceding second rotational motion. Analogously to this, the further second motion signal 318 causes a further second rotational motion of the drum in the second direction until the drum has reached a further second target rotational speed greater than the further first target rotational speed of the preceding further first rotational motion. As a result, according to this embodiment, the drum is caused to execute a rocking rhythm. The third motion signal 320 causes a third rotational motion of the drum at the predetermined maximum rotational speed 310 in the previously targeted direction. As a result, the control unit 108 allows the cleaning appliance to execute a spin program. According to one embodiment, the third rotational motion follows seamlessly from the preceding rotational motion. Thus, the third rotational motion can continue a rotational motion as soon as the maximum rotational speed is reached. The third rotational motion is characterized by a plurality of complete revolutions in the same direction of rotation.

According to this embodiment, the computing unit 300 is only optionally designed to determine a rocking frequency 322 using the drum radius value 306. According to one embodiment, the drum radius value 306 can optionally be read in via an interface of a memory unit. Also optionally, the supply unit 302 is designed to supply the second motion signal 314, the further first motion signal 316, and the further second motion signal 318 for a predetermined period of time, which corresponds to half a period duration of the rocking frequency 322. According to this embodiment, the first motion signal 312, the second motion signal 314, the further first motion signal 316, and the further second motion signal 318 optionally cause a constant acceleration of the drum. More specifically, the first motion signal 312 causes a first acceleration of the drum, the second motion signal 314 causes a second acceleration of the drum greater than the first acceleration, the further first motion signal 316 causes a further first acceleration of the drum greater than the second acceleration, and the further second motion signal 318 causes a further second acceleration greater than the further first acceleration.

The third motion signal 320 is supplied by the supply unit 302 for a third period of time, which according to this embodiment is a multiple of the period duration. According to this embodiment, the computing unit 300 optionally calculates the rocking frequency 322 as a quotient from the square root of a quotient of the gravitational constant 308 and the drum radius value 306 as well as the doubled number Pi.

According to this embodiment, the computing unit 300 increases the rocking frequency 322 by a predetermined factor, which is between 10% and 40%, for example. Advantageously, however, the factor is 20%. The factor is stored in a memory unit, for example.

In other words, according to this embodiment, the control unit 108 is designed to execute a rocking washing rhythm for the cleaning appliance in order to place the textiles securely against the drum casing despite a tendency to slide in the drum. This means that a possible imbalance can be measured, for example, and the textiles can be spun.

Figure 4:
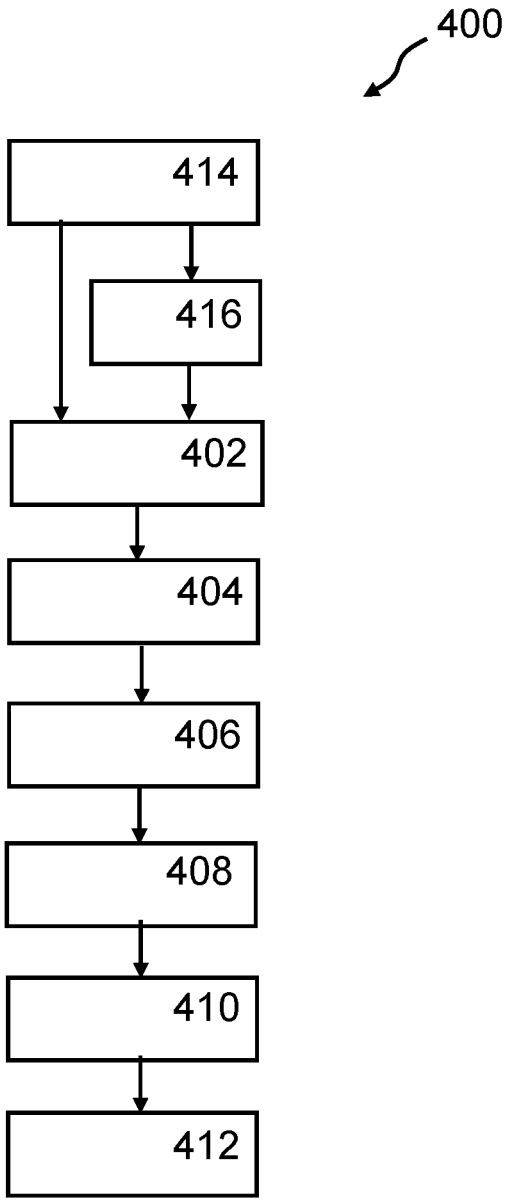
FIG. 4 is a flowchart of a method for executing a spin program for a cleaning appliance according to one embodiment.

FIG. 4 is a flowchart of a method 400 for executing a spin program for a cleaning appliance according to one embodiment. The method 400 can be executed in a cleaning appliance, for example, as was described in FIG. 1. This method is executed or controlled by a control unit, for example, as was described in FIG. 3.

The method 400 comprises a step 402 of supplying a first motion signal to an interface of a drive of the cleaning appliance. In this case, the first motion signal causes a first rotational motion of the drum in a first direction until the drum has reached a first target rotational speed. In a step 404 of supplying, a second motion signal is supplied to the interface of the drive, wherein the second motion signal causes a second rotational motion of the drum in a second direction opposite to the first direction, until the drum has reached a second target rotational speed greater than the first target rotational speed.

The method 400 also comprises a step 406 of further supplying a further first motion signal to the interface of the drive of the cleaning appliance. The further first motion signal causes a further first rotational motion of the drum in the first direction until the drum has reached a further first target rotational speed greater than the second target rotational speed of the preceding second rotational motion. In a step 408 of further supplying, a further second motion signal is supplied to the interface of the drive, wherein the further second motion signal causes a further second rotational motion of the drum in the second direction until the drum has reached a further second target rotational speed greater than the further first target rotational speed of the preceding further first rotational motion. The method 400 also comprises a step 410 of repeating at least one of steps 406, 408 of further supplying, until the further first target rotational speed or the further second target rotational speed reaches a predetermined maximum rotational speed.

For example, in the step 410 of repeating, the maximum rotational speed is reached in a third repetition process. This means that, for example, executing three rocking motions of the drum is sufficient.

In a step 412 of supplying, a third motion signal is supplied to the interface of the drive, wherein the third motion signal represents a third rotational motion of the drum at the predetermined maximum rotational speed in the direction of the preceding step of further supplying. This ensures that, for example, the textiles in the non-ribbed drum are distributed against the drum casing before, for example, the cleaning appliance starts the spin program. This avoids the formation of an imbalance, for example, which would result in damage to the cleaning appliance.

Furthermore, only optionally, the method 400 comprises a step 414 of calculating the maximum rotational speed using a predetermined g-factor, a drum radius value representing a drum radius of the drum, and the gravitational constant.

According to this embodiment, the method 400 comprises a step 416 of determining the rocking frequency using the drum radius value. According to this embodiment, a step 416 of determining can be executed before a step 402 of supplying the first motion signal, as well as a step 414 of calculating. The steps 414, 416 can also be executed simultaneously.

Figure 5:
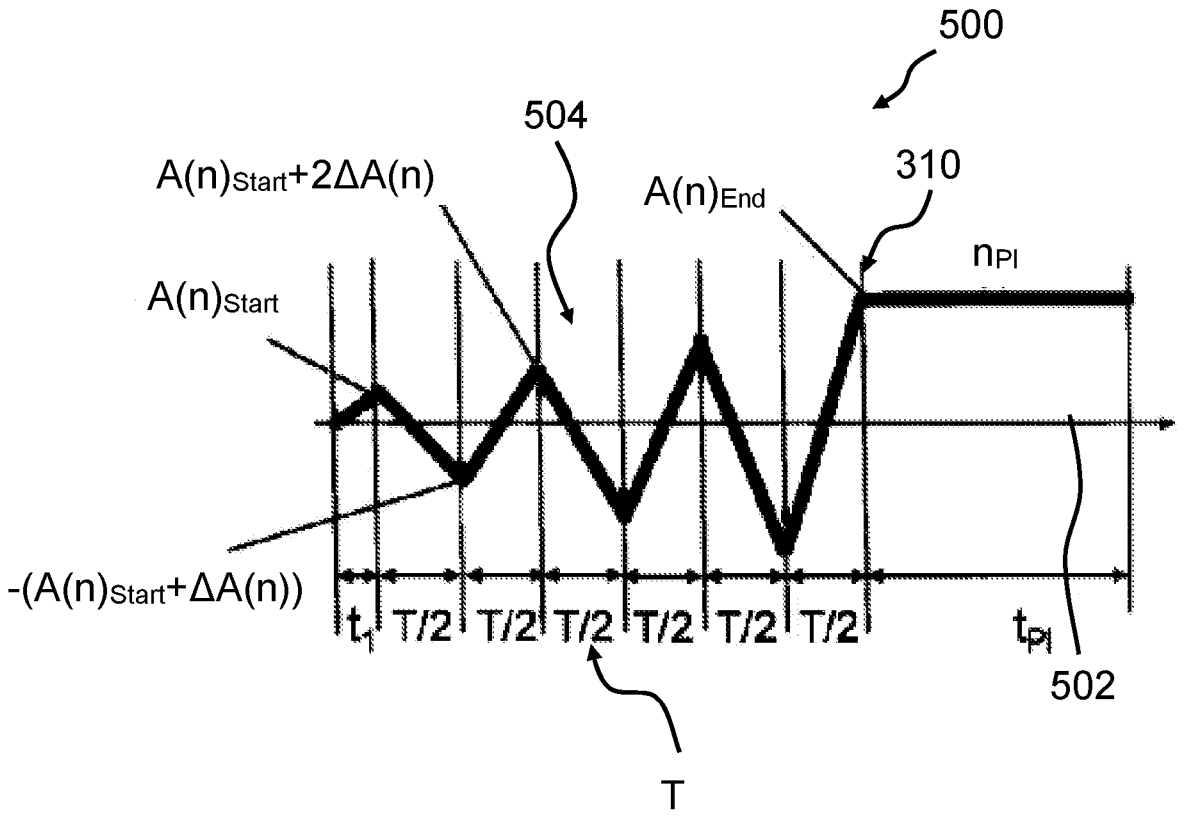
FIG. 5 is a rocking curve diagram for a cleaning appliance according to one embodiment.

FIG. 5 shows a rocking curve diagram 500 for a cleaning appliance according to one embodiment. The rotational speed is shown on the ordinate and the time on the abscissa. The rocking curve diagram 500 can, for example, correspond to the rotational motions of the drum over time 502, as described in the method for executing a spin program for a cleaning appliance, which is described in FIG. 4. This means that, according to this embodiment, the rotational motions of the drum are represented using an amplitude profile 504. The amplitude profile 504 makes it clear that the drum initially executes a rocking motion a plurality of times and thereby achieves a higher rotational speed value with each rocking motion. According to this embodiment, when the maximum rotational speed is reached, the drum motion accelerates, which means that the drum continues to rotate in the current direction and, for example, a spin program of the cleaning appliance is executed. According to this embodiment, the direction of rotation of the drum does not change.

According to one embodiment, the drum is first rotated in a first direction for a period of time $t_1$ until a rotational speed A(n)Start is reached. The period of time $t_1$ is shorter than or equal to half the period duration T of the rocking frequency. The drum is then rotated alternately in opposite directions, each time for a period of time of half a period duration T/2. With each rotation, the rotational speed is increased until the maximum rotational speed is reached, at which the drum is then rotated further without changing direction for a period of time $t_{PI}$. The period of time $t_{PI}$ is greater than a multiple of the period duration T. According to the embodiment shown, after the drum has started turning, it is rotated in a second direction opposite to the first direction, a rotational speed $-(A(n)_{Start}+\Delta A(n))$ being reached. Immediately afterwards, the drum is rotated in the first direction, wherein a rotational speed $A(n)_{Start}+2\Delta A(n)$ is reached. Immediately afterwards, the drum is rotated again in the second direction, immediately afterwards again in the first direction, immediately afterwards again in the second direction, and immediately afterwards again in the first direction, wherein a rotational speed $A(n)_{End}$ is reached which is equivalent to the maximum rotational speed.

In other words, the drum is set in a rocking motion, i.e. in a right-left motion, which causes the textiles to execute a rocking motion. This has the advantage that an amplitude of this rocking motion, which is shown herein as an amplitude profile 504, is gradually increased until it is so large that, by keeping the maximum rotational speed 310 of the rocking motion constant, the textiles, also referred to as laundry, lie securely in contact with the drum casing without falling. The rocking frequency $f_{rocking}$ is to be adapted to the drum radius $r_{drum}$ of the drum according to the physical formula of the rocking frequency. The gravitational constant g is specified according to this embodiment and is g=9.81 m/s$^2$:

$$f_{rocking} = \frac{\sqrt{\frac{g}{r_{drum}}}}{2\pi}$$

In order to implement the rocking motion, according to this embodiment, a triangular rotational speed curve with increasing amplitude is executed in the corresponding rocking frequency. The triangular shape is achieved by alternating acceleration of the drive with constant acceleration in portions, without having to map a sine curve. Since the curve of the angle of rotation represents the integral of the rotational speed curve, it still runs almost sinusoidally due to the properties of the integration, so that an attenuation of the higher frequency components of −20 dB/decade is achieved. According to this embodiment, such an approach is sufficient in practice to safely entrain the textiles without sliding. An exact sine curve is not necessary. The triangular curve has the advantage that it can be implemented with a lower computing power of a drive controller, which is referred to herein as a control unit.

Parameterisation is advantageously executed taking into account the previously calculated rocking frequency. Since this refers to the drum radius, but the centre of gravity of the textiles is further inwards, the actual rocking frequency is approx. 20% higher. Therefore, according to this embodiment, the period duration T is correspondingly reduced by 10 to 40%, preferably 20%. A plateau rotational speed $n_{PI}$, which is also referred to herein as maximum rotational speed 310, is determined with the aid of the g-factor, which is dependent on the drum radius. The g-factor is calculated according to:

$$g\text{–Factor}=r_{drum}(2\pi n/60\ \text{rpm/s}))^2/g$$

where n is the rotational speed, π the numer Pi (3.1415926535) and g the gravitational constant (9.81 m/s$^2$). Since the radius of the textiles moving on the circular path is smaller than the drum radius, a g-factor greater than 1 is used. According to this embodiment, the g-factor is therefore in the range of between 2 and 6, preferably 4. Changing the formula results in the corresponding plateau rotational speed $n_{PI}$, for example. A portion of a first half period $k_1$ is set in the range of between 0.2 and 1 and is preferably 1 in order to implement a suitable phase assignment when transitioning to the plateau rotational speed. A starting rotational speed amplitude $A(n)_{start}$ and an amplitude increment ΔA(n) are both set in a range of between $n_{PI}/10$ and $n_{PI}/4$ and are preferably at $n_{PI}/4$. This means that the run-up takes place after 3 rocking motions. If, for example, the maximum rotational speed 310 is 120 rpm, the amplitude increment and the starting speed amplitude are each 120 rpm/4=30 rpm, so that the run-up takes place in the following steps as an example:

accelerating up to 30 rpm anti-clockwise so that the textiles deflect to the right.

braking anti-clockwise and accelerating clockwise up to 60 rpm so that the textiles deflect to the left.

braking clockwise and accelerating anti-clockwise up to 90 rpm so that the textiles deflect to the right.

braking anti-clockwise and accelerating clockwise up to 120 rpm, then holding at 120 rpm so that the rocking motion is returned, and the rotational speed is maintained with the textiles lying against the drum during the anti-clockwise rocking return motion.

This makes it possible to position or spin textiles that tend to slide or roll in a non-ribbed drum without, for example, creating an imbalance that can arise, for example, when the textiles are suddenly lying against the drum at a high rotational speed.

The described approach can be used advantageously in the washing process technology for the non-ribbed drum cleaning appliances. In this way, it can be ensured that, even with a small amount of laundry, the items of laundry do not slide when the drum is rotated and are entrained by the drum. As a result, the laundry lies in contact with the drum casing for spinning if there is sufficient centrifugal force. By the turning start as described, it can be avoided that the items of laundry suddenly come into contact only at a higher rotational speed, at which the friction between the drum and the items of laundry is very great. As a result, the formation of an imbalance can be avoided, and it can also be avoided that the washing machine vibrates strongly and thereby leaves its set-up position.

The invention claimed is:

1. A method for executing a spin program for a cleaning appliance having a rotatable non-ribbed drum for holding the textiles, the method comprising the following steps:

supplying a first motion signal to an interface of a drive of the cleaning appliance, wherein the first motion signal causes a first rotational motion of the drum in a first direction until the drum has reached a first target rotational speed;

supplying a second motion signal to the interface of the drive, wherein the second motion signal represents a second rotational motion of the drum in a second direction opposite to the first direction, until the drum has reached a second target rotational speed greater than the first target rotational speed;

further supplying a further first motion signal to the interface of the drive of the cleaning appliance, wherein the further first motion signal causes a further first rotational motion of the drum in the first direction, until the drum has reached a further first target rotational speed greater than the second target rotational speed of the preceding second rotational motion;

further supplying a further second motion signal to the interface of the drive, wherein the further second motion signal causes a further second rotational motion of the drum in the second direction until the drum has reached a further second target rotational speed greater than the further first target rotational speed of the preceding further first rotational motion;

repeating at least one of the steps of further supplying until the further first target rotational speed or the further second target rotational speed reaches a predetermined maximum rotational speed; and supplying a third motion signal to the interface of the drive, wherein the third motion signal causes the drum to execute a third rotational motion at the predetermined maximum rotational speed in the direction of the preceding step of repeating at least one of the steps of further supplying.

2. The method according to claim 1, comprising a step of calculating the maximum rotational speed using a predetermined g-factor, a drum radius value representing a drum radius of the drum, and the gravitational constant.

3. The method according to claim 1, wherein the second motion signal, the further first motion signal, and the further second motion signal are supplied for a predetermined period of time, wherein the predetermined period of time corresponds to half a period duration of a rocking frequency.

4. The method according to claim 3, wherein the third motion signal is supplied for a third period of time, wherein the third period of time is a multiple of the period duration.

5. The method according to claim 3, comprising a step of determining the rocking frequency using the drum radius value.

6. The method according to claim 5, wherein, in the step of determining, the rocking frequency is determined as a quotient of the square root from a quotient of the gravitational constant and the drum radius value as well as the doubled number Pi.

7. The method according to claim 5, wherein, in the step of determining, the rocking frequency is increased by a predetermined factor.

8. The method according to claim 1, wherein the first motion signal, the second motion signal, the further first motion signal, and the further second motion signal cause a constant acceleration of the drum.

9. The method according to claim 8, wherein the first motion signal causes a first acceleration of the drum, the second motion signal causes a second acceleration of the drum greater than the first acceleration, the further first motion signal causes a further first acceleration of the drum greater than the second acceleration, and the further second motion signal causes a further second acceleration greater than the further first acceleration.

10. The method according to claim 1, wherein, in the step of repeating, the maximum rotational speed is reached in a third repeat process.

11. A control unit configured to execute the steps of the method according to claim 1 in corresponding units.

12. A non-transitory computer-readable medium having program code for executing the method according to claim 1.

13. A cleaning appliance for cleaning textiles, comprising:

a rotatable non-ribbed drum for holding the textiles;

a drive for causing the drum to execute a rotational motion; and a control unit according to claim 11.

* * * * *